US006121142A

United States Patent [19]

Crevasse et al.

[11] Patent Number: 6,121,142

[45] Date of Patent: Sep. 19, 2000

[54] MAGNETIC FRICTIONLESS GIMBAL FOR A POLISHING APPARATUS

[75] Inventors: Annette M. Crevasse; William G. Easter; John A. Maze, all of Orlando, Fla.

[73] Assignee: Lucent Technologies Inc., Murray Hill, N.J.

[21] Appl. No.: 09/152,752

[22] Filed: Sep. 14, 1998

[51] Int. Cl.[7] ..... H01L 21/302; H01L 21/461

[52] U.S. Cl. ..... 438/691; 438/692

[58] Field of Search ..... 451/5, 9, 41, 528, 451/529, 526, 286, 287; 438/691, 692, 693; 156/345

[56] References Cited

U.S. PATENT DOCUMENTS 5,242,524 9/1993 Leach et al. ..... 156/345
5,559,428 9/1996 Li et al. ..... 324/71.5
5,607,341 3/1997 Leach ..... 451/41
5,618,447 4/1997 Sandhu ..... 451/5
5,882,243 3/1999 Das et al. ..... 451/5

*Primary Examiner*—Benjamin L. Utech
*Assistant Examiner*—Duy-Vu Deo

[57] ABSTRACT

The present invention provides, for use with a polishing apparatus, a carrier structure comprising a first magnetic body, a second magnetic body, and a retaining ring. In one advantageous embodiment, the first magnetic body has a first side coupleable to the polishing apparatus, and a second side. The second magnetic body has a first side proximate and juxtaposed the second side of the first magnetic body. The second magnetic body is coupled to the first magnetic body to allow undulant motion with respect to the first magnetic body. The first and second magnetic bodies are configured to have a like polarity. The retaining ring is coupled to the second side of the second magnetic body and forms a retaining cavity configured to receive an object to be polished. Thus, the first and second magnetic bodies may cooperate to form a frictionless gimbal.

4 Claims, 3 Drawing Sheets

MAGNETIC FRICTIONLESS GIMBAL FOR A POLISHING APPARATUS

TECHNICAL FIELD OF THE INVENTION

The present invention is directed, in general, to a gimbal for a polishing apparatus and, more specifically, to a magnetic, frictionless gimbal for use with a semiconductor polishing apparatus.

BACKGROUND OF THE INVENTION

In the manufacture of microcircuit dies, chemical/mechanical polishing (CMP) is used to provide smooth topographies of the semiconductor wafers. One who is skilled in the art is familiar with such CMP process. Referring now to FIG. 1, illustrated is a sectional view of a conventional wafer carrier head assembly 100 comprising a carrier head 110, a carrier gimbal 120, a drive shaft 130, a wafer carrier 140, and a wafer retaining ring 150. Also shown in FIG. 1 is a conventional semiconductor wafer 160 mounted within the wafer carrier 140, and a polishing platen 170. A wafer polishing surface 165 and a platen surface 175 are also designated. Ideally, the wafer surface 165 and the platen surface 175 are parallel and exactly horizontal. However, the carrier gimbal 120 is designed to allow for local deviations from the horizontal between the wafer surface 165 and the platen surface 175. The gimbal 120 is effectively a universal joint, between the drive shaft 130 and the carrier head 110. Should there be a deviation of the platen surface 175 from the horizontal at any point, the gimbal 120 allows the carrier head 110 to follow the contour of the local surface by tilting appropriately on two orthogonal, essentially-horizontal axes 121, 122.

A major problem exists with the conventional gimbal design shown, i.e., the higher the gimbal is from the wafer surface 165, the slower is the response of the carrier head 110 to deviations from the horizontal. The fact that a relatively long moment arm 180 exists between the conventional gimbal 120 and the wafer surface 165 causes the problem. Therefore, efforts have been previously made to shorten the moment arm 180 in order to make the gimbal 120 more responsive. Ideally, the moment arm 180 would be minimized by placing the gimbal 120 in the carrier head 110, as close as physically possible to the wafer surface 165. Such a location would provide a gimbal with the fastest response to local deviations of the platen 175 from the horizontal. However, physical considerations make placing a mechanical gimbal 120 deep within the carrier head 110 extremely difficult.

Accordingly, what is needed in the art is a gimbal that can be mounted in the carrier head in close proximity to the semiconductor wafer to provide the most rapid response possible to local variations of the platen from the horizontal.

SUMMARY OF THE INVENTION

To address the above-discussed deficiencies of the prior art, the present invention provides, for use with a polishing apparatus, a carrier structure comprising a first magnetic body, a second magnetic body, and a retaining ring. In one advantageous embodiment, the first magnetic body has a first side coupleable to the polishing apparatus, and a second side. The second magnetic body has a first side proximate and juxtaposed the second side of the first magnetic body. The second magnetic body is coupled to the first magnetic body to allow undulant motion with respect to the first magnetic body. The adjacent sides of the first and second magnetic bodies are configured to have a like polarity. The retaining ring is coupled to the second side of the second magnetic body and forms a retaining cavity configured to receive an object to be polished.

In another embodiment, the second magnetic body is coupled to the first magnetic body by at least two pins. The two pins are configured to transmit a rotational force from the first magnetic body to the second magnetic body.

In another embodiment, the first and second magnetic bodies are electromagnetic. In an alternative embodiment, however, the first and second magnetic bodies have a natural or non-electromagnetic induced magnetism. For example, the first and second bodies may be comprised of a material that is naturally magnetized or the magnetism may be induced by subjecting the body to a magnetic field until the body become magnetized.

In another aspect of the present invention, a vacuum conduit is formed between the first and second magnetic bodies. The vacuum conduit is configured to couple to a vacuum source of the polishing apparatus, which can be used to hold the object that is to be polished against the second body during polishing.

In yet another aspect of the present invention, the retaining ring is located on an outer perimeter of the second magnetic body and is configured to retain a semiconductor wafer. In another embodiment, the second side of the second magnetic body forms a pressure plate of the carrier device. In a particularly advantageous embodiment, the first and second magnetic bodies cooperate to form a frictionless gimbal.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
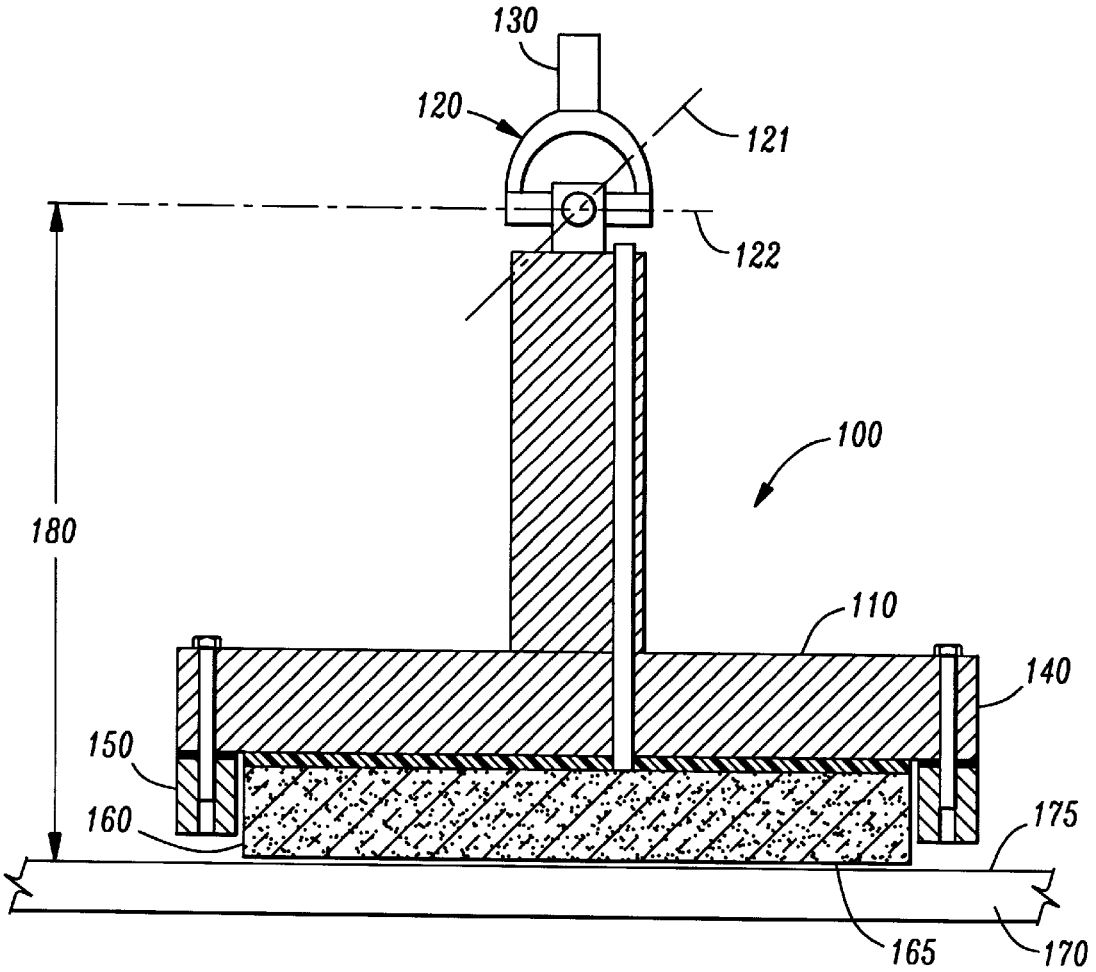
FIG. 1 (PRIOR ART)
FIG. 1 illustrates a sectional view of a conventional wafer carrier head assembly.
Figure 2:
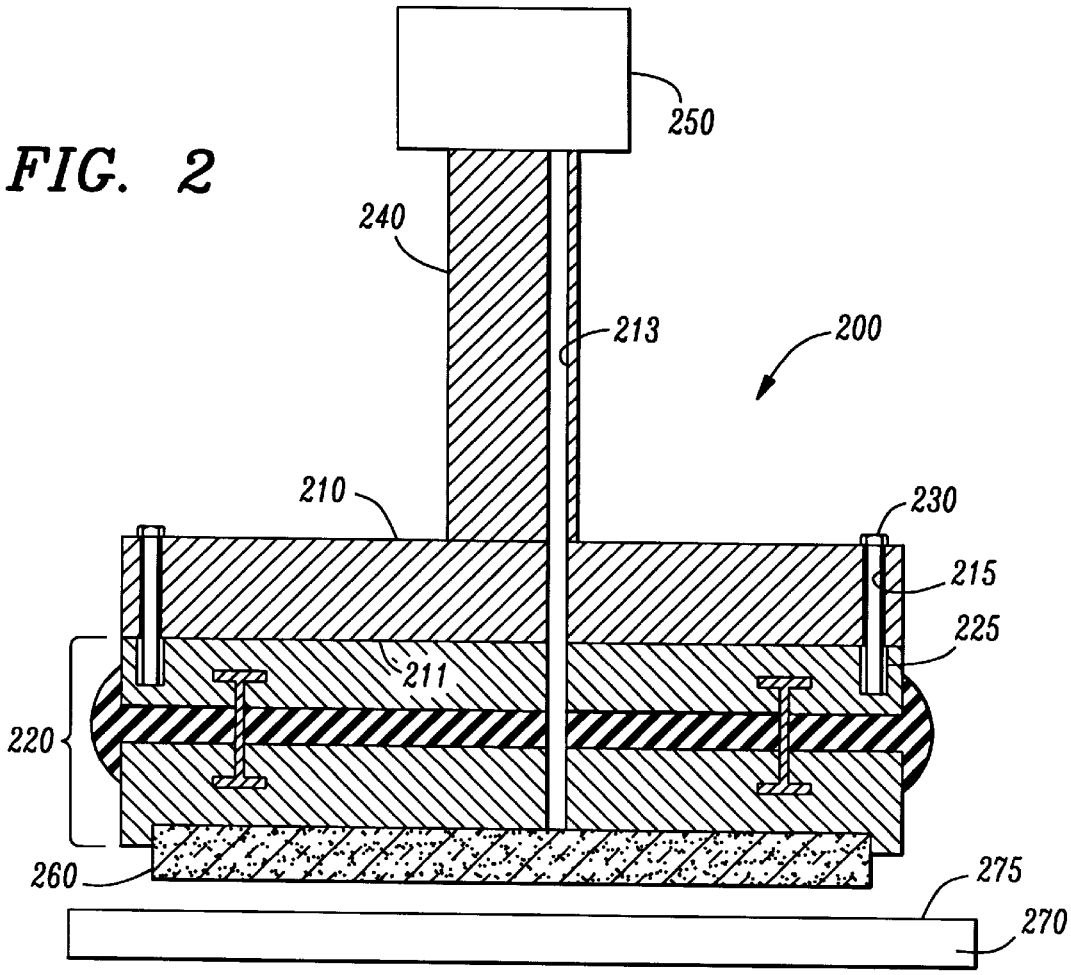
FIG. 2 illustrates a sectional view of one embodiment of a semiconductor polishing apparatus constructed according to the principles of the present invention.

Referring now to FIG. 2, illustrated is a sectional view of one embodiment of a semiconductor polishing apparatus constructed according to the principles of the present invention. A semiconductor polishing apparatus 200 comprises a carrier head 210; a carrier structure 220, which may also be termed magnetic gimbal plates, as provided by the present invention; a plurality of mounting bolts 230; a drive shaft 240; and a drive motor 250. Mounted within the carrier structure 220 is a conventional semiconductor wafer 260. Proximate the semiconductor wafer 260 is a polishing platen 270 with a polishing platen surface or pad 275. One who is skilled in the art is familiar with the general configuration and operation of a semiconductor polishing apparatus 200.

The conventional carrier head 210 comprises a lower face 211, a vacuum conduit 213, and a plurality of fastener apertures 215. The lower face 211 is planar and substantially parallel to the polishing platen surface 275. The vacuum conduit 213 passes through the carrier head 210, and connects to a vacuum source (not shown). The plurality of mounting bolts 230 pass through the corresponding plurality of fastener apertures 215 and mate with a corresponding plurality of internally threaded apertures 225 within the carrier structure 220.

Figure 3:
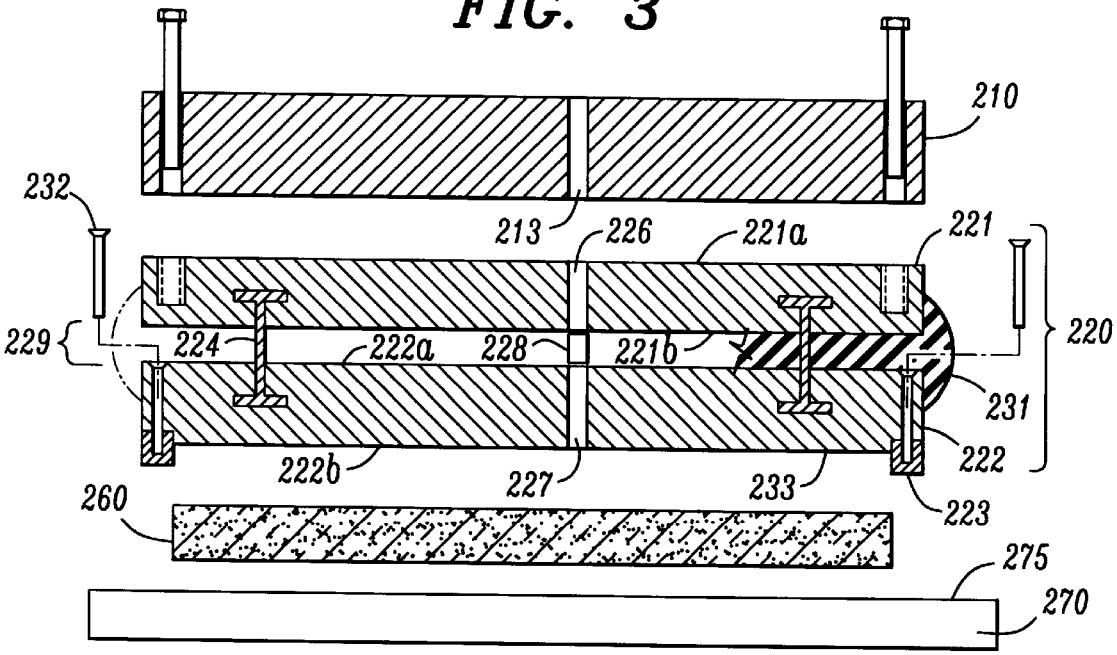
FIG. 3 illustrates an exploded sectional view of one embodiment of the carrier structure of FIG. 2.

Referring now to FIG. 3 with continuing reference to FIG. 2, illustrated is an exploded sectional view of one embodiment of the carrier structure of FIG. 2. The carrier structure 220 comprises a first magnetic body 221, a second magnetic body 222, a retaining ring 223, at least two pins 224, and an elastomeric seal 231. The first magnetic body 221 comprises a first side 221*a* and a second side 221*b* that may also be referred to as the opposite poles of the magnetic body 221, i.e., one being a north pole and the other being a south pole. Likewise, the second magnetic body 222 comprises a first side 222*a* and a second side 222*b* that may also be referred to as opposite magnetic poles.

In one embodiment, the first magnetic body 221 may be formed of a natural or non-electromagnetic induced (i.e., permanent magnetic) material so that the second side 221*b* of the first magnetic body 221 is a selected magnetic pole, e.g., a north pole. In this embodiment, the second magnetic body 222 is formed of a permanent magnetic material so that the first side 222*a* is a magnetic pole of the same polarity, i.e., north, as the second side 221*b* of the first magnetic body 221. One who is skilled in the art will recognize that the choice of poles is not material to the present invention, and may just as easily be a south magnetic pole, so long as the selected poles are of like polarity. In an alternative embodiment, the first and second magnetic bodies 221, 222 may be formed of materials with electromagnetic properties that can be used to create a polarized magnetic field when subjected to an electric current.

In another alternative embodiment, either the first or second magnetic body may be formed of a permanent magnetic material while the other magnetic body is formed of an electromagnetic material. One who is skilled in the art will readily recognize that the only requirement is that the second side 221*b* of the first magnetic body 221 and the first side 222*a* of the second magnetic body 222 be of the same magnetic polarity. Furthermore, the first side 222*a* of the second magnetic body 222 is proximate and juxtaposed the second side 221*b* of the first magnetic body 221. Thus, because of the repellent force of the two like magnetic poles, the first and second magnetic bodies 221, 222 tend to repel each other, maintaining a magnetic cushion 229 between the bodies 221, 222. In the illustrated embodiment, the pins 224 are located between and coupled to the first and second magnetic bodies 221, 222. The pins 224 maintain the operating alignment of the first and second magnetic bodies 221, 222. The pins 224 also limit the distance that the repelling motion of the first and second magnetic bodies 221, 222 may force the bodies apart i.e., maintain a designed and desired distance between the first and second magnetic bodies 221, 222. The elastomeric seal 231 functions to prevent polishing contaminants from entering the gap formed by the magnetic cushion 229. In one embodiment, a rotational force applied by the motor 250 to the shaft 240, the carrier head 210, and the first magnetic body 221, in turn, is further transmitted by the pins 224 to the second magnetic body 222. One who is skilled in the art will recognize that the pins may vary in shape, number, and location to accomplish one or more of the aforementioned tasks.

In the illustrated embodiment, the retaining ring 223 is coupled to the second side 222*b* of the second magnetic body 222 by a plurality of machine screws 232. The retaining ring 223 forms a retaining cavity 225 that is configured to receive the semiconductor wafer 260. The first magnetic body 221 and the second magnetic body 222 further comprise vacuum conduits 226, 227, respectively. Vacuum conduits 226, 227 are coupled by a flexible conduit 228 between the second side 221*b*, and the first side 222*a*. The vacuum conduit 226 is further coupled to the polishing apparatus vacuum conduit 213 at the first face 221*a* of the first magnetic body 221. One who is skilled in the art is familiar with the use of a vacuum in semiconductor wafer polishing carriers for wafer transfer operations or polishing. In an alternative embodiment, vacuum conduits 226, 227 may be used to apply a pressure to the semiconductor wafer 260.

In one embodiment, the second side 222*b* of the second magnetic body 222 may be formed to function as a pressure plate acting upon the semiconductor wafer 260. In an alternative embodiment, a separate pressure plate (not shown) may be formed to cooperate with the retaining ring 223 to form the cavity 225; the pressure plate and retaining ring 223 being coupled to the second magnetic body 222. One who is skilled in the art is familiar with the design, function, and operation of a pressure plate for semiconductor wafer polishing.

Figure 4A:
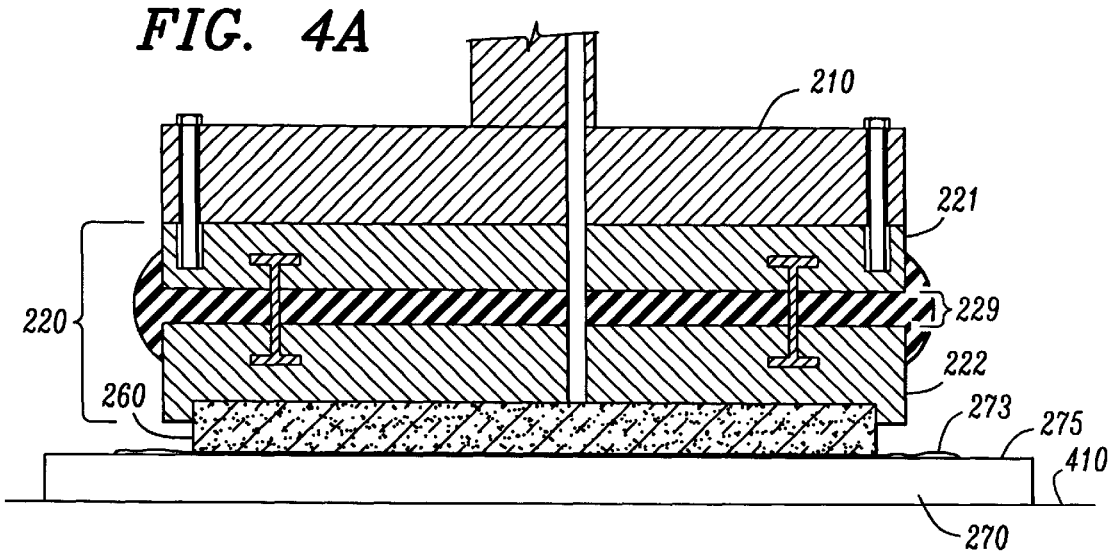
FIGS. 4A, 4B, and 4C illustrate one embodiment of a polishing head of a CMP apparatus equipped with a magnetic gimbal constructed according to the principles of the present invention.
Figure 4B:
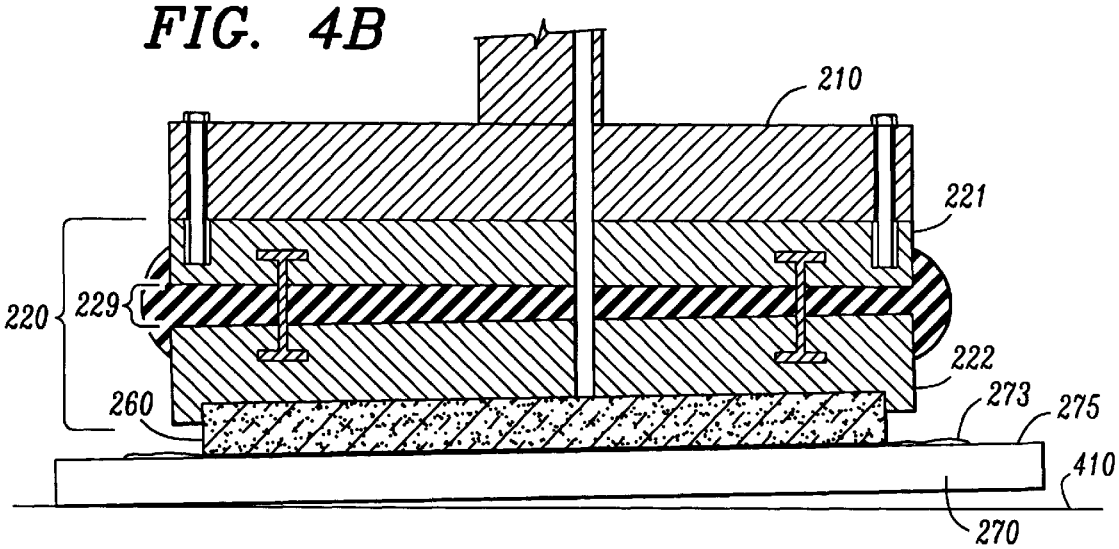
Figure 4C:
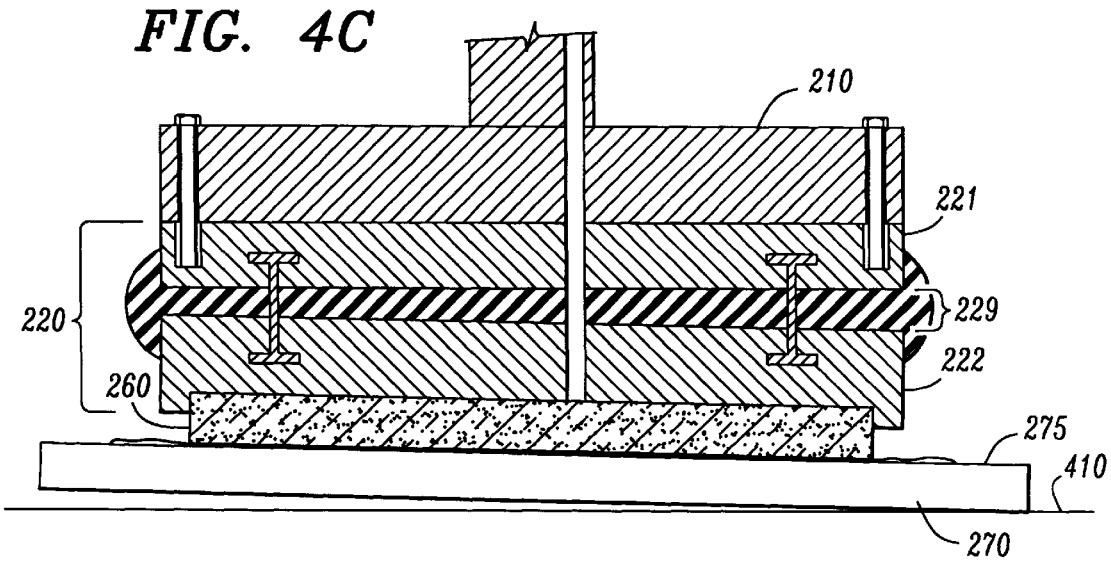

Referring now to FIGS. 4A, 4B, and 4C with continuing reference to FIGS. 2 and 3, illustrated is one embodiment of a polishing head of a CMP apparatus equipped with a magnetic gimbal constructed according to the principles of the present invention. To initiate CMP, a chemical and mechanical polishing slurry 273 is ejected onto the polishing platen surface 275, and the semiconductor wafer 260 is placed in the slurry 273 in contact with the polishing platen surface 275. One who is skilled in the art is familiar with the operation of a CMP apparatus and the nature of the CMP slurry. As either the platen 270 or the carrier head 210, or both are rotated, the magnetic gimbal 220 allows for variations in the polishing platen surface 275. The polishing platen surface 275 may undulate, i.e., make variable movements, with respect to a fixed horizontal reference plane 410. As the surface 275 undulates (as shown in FIGS. 4B and 4C), the semiconductor wafer 260 follows the undulations maintaining a proximate relationship with the surface 275. Thus, the magnetic field 229 induced in the first and second magnetic bodies 221, 222 allows the second magnetic body 222 to follow the platen surface 275 undulations, while the polishing head 210 remains oriented to the motor 250 and shaft 240. One who is skilled in the art will also recognize that the gimbal of the present invention will also compensate for any small deviations of the drive shaft 240 from the vertical. Because the magnetic gimbal 220 is located in close proximity to the retaining cavity 225 and the semiconductor wafer 260, the second magnetic body 222 follows the undulations with a faster response rate than could be achieved with a gimbal of the prior art. Also, because the gimbal is magnetic, there is essentially no friction between the first and second magnetic bodies 221, 222 as would be found in a mechanical gimbal of the prior art.

Although the present invention has been described in detail, those skilled in the art should understand that they can make various changes, substitutions and alterations herein without departing from the spirit and scope of the invention in its broadest form.

What is claimed is:

1. A method for polishing a semiconductor wafer, comprising:

effecting a magnetic field between a first magnetic body slidably coupled and a second magnetic body of a carrier structure coupled to a polishing apparatus, and maintaining a variable, and spatial relationship between said first and second magnetic bodies;

retaining a semiconductor wafer within a retaining cavity formed by a retaining ring coupled to said second magnetic body;

placing said semiconductor wafer against a polishing platen; and polishing said semiconductor wafer against said platen, said magnetic field allowing said second magnetic body to undulate with respect to said first magnetic body to allow said semiconductor wafer to traverse irregularities in said polishing platen.

2. The method as recited in claim 1 wherein effecting a magnetic field includes generating a magnetic field of a known polarity in said first magnetic body, and generating a magnetic field of a like polarity in said second magnetic body.

3. The method as recited in claim 2 wherein generating a magnetic field includes inducing a magnetic field by applying electric current to said first and second magnetic bodies.

4. The method as recited in claim 1 wherein said first and second magnetic bodies have a natural or non-electromagnetic induced magnetism of like polarity and effecting a magnetic field is formed by said natural or non-electromagnetic induced magnetism of said first and second bodies.

* * * * *